US011846078B2

(12) United States Patent
Johnson et al.

(10) Patent No.: US 11,846,078 B2
(45) Date of Patent: Dec. 19, 2023

(54) CHUTE ROTATION ASSEMBLY FOR SNOW REMOVAL DEVICE

(71) Applicant: Husqvarna AB, Huskvarna (SE)

(72) Inventors: Mike Johnson, Charlotte, NC (US); Kenneth Mandeville, Weddington, NC (US)

(73) Assignee: HUSQVARNA AB, Huskvarna (SE)

( * ) Notice: Subject to any disclaimer, the term of this patent is extended or adjusted under 35 U.S.C. 154(b) by 1062 days.

(21) Appl. No.: 16/616,064

(22) PCT Filed: Aug. 22, 2018

(86) PCT No.: PCT/IB2018/056365
§ 371 (c)(1),
(2) Date: Nov. 22, 2019

(87) PCT Pub. No.: WO2019/038695
PCT Pub. Date: Feb. 28, 2019

(65) Prior Publication Data

US 2020/0141077 A1 May 7, 2020

Related U.S. Application Data

(60) Provisional application No. 62/549,050, filed on Aug. 23, 2017.

(51) Int. Cl.
*E01H 5/04* (2006.01)
*E01H 5/09* (2006.01)

(52) U.S. Cl.
CPC ..... *E01H 5/045* (2013.01); *E01H 5/09* (2013.01)

(58) Field of Classification Search
CPC ..... E01H 5/045; E01H 5/09
See application file for complete search history.

(56) References Cited

U.S. PATENT DOCUMENTS 3,334,429 A * 8/1967 Price ..... E01H 5/04 37/243
3,808,715 A * 5/1974 Haban ..... E01H 5/045 406/165

(Continued)

FOREIGN PATENT DOCUMENTS

WO 2012/177234 A1 12/2012

OTHER PUBLICATIONS

International Search Report and Written Opinion for International Application No. PCT/IB2018/056365 dated Nov. 21, 2018.

*Primary Examiner* — Jessica H Lutz
(74) *Attorney, Agent, or Firm* — BURR & FORMAN LLP

(57) ABSTRACT

A snow removal device may include an engine assembly operably coupled at least in part to a frame of the snow removal device. The snow removal device may further include a mobility assembly operably coupled to the frame and the engine assembly to provide mobility of the snow removal device responsive at least in part to operation of the engine assembly. The snow removal device may even further include an ejection assembly that includes a chute for ejecting material from the snow removal device, and a handle assembly that includes a lever assembly. Moreover, the snow removal device may also include a chute rotation assembly operably coupled to the chute of the ejection assembly. The chute rotation assembly may include a cable system, the cable system operably coupling the lever assembly to the chute rotation assembly. The chute rotation assembly may also include a disc clutch assembly configured to move between an engaged position and a disengaged position in response to actuation of the lever assembly, where when the disc clutch assembly is in the disengaged (Continued)

position, the chute is enabled to rotate between a plurality of positions.

15 Claims, 7 Drawing Sheets

(56) References Cited

U.S. PATENT DOCUMENTS 3,921,315 A * 11/1975 Tome ..... E01H 5/045 37/260
4,104,812 A * 8/1978 Stribiak, Jr. ..... E01H 5/04 37/243
4,205,468 A * 6/1980 Greider ..... E01H 5/045 406/161
4,409,748 A * 10/1983 Westimayer ..... E01H 5/045 285/272
5,438,770 A * 8/1995 Miller ..... E01H 5/04 37/249
6,058,629 A * 5/2000 Peterson ..... E01H 5/045 37/261
6,502,335 B2 * 1/2003 Prochnow ..... E01H 5/045 476/24
6,952,893 B1 * 10/2005 Sanderson ..... E01H 5/045 37/261
7,093,380 B2 * 8/2006 Hubscher ..... E01H 5/098 37/231
7,165,345 B2 * 1/2007 Beaudoin ..... E01H 5/045 37/247
7,347,013 B2 * 3/2008 Deschler ..... E01H 5/045 37/260
7,540,102 B2 * 6/2009 Olmr ..... E01H 5/04 37/249
8,016,098 B2 * 9/2011 Saiia ..... E01H 5/045 198/640
9,290,897 B2 * 3/2016 Schisel ..... E01H 5/045
9,556,572 B2 * 1/2017 Duchscherer ..... B62D 11/02
10,428,477 B2 * 10/2019 Hiller ..... E01H 5/045
10,899,266 B2 * 1/2021 Kimura ..... B60Q 1/0017
11,254,376 B2 * 2/2022 Mandeville ..... B62D 55/04
2003/0177669 A1 9/2003 Beaudoin
2007/0175070 A1 8/2007 Deschler et al.
2008/0163520 A1 7/2008 White et al.
2012/0246865 A1 * 10/2012 Lauer ..... A01D 42/06 15/405
2014/0157633 A1 * 6/2014 Hansen ..... E01H 5/09 37/260
2015/0252542 A1 * 9/2015 Houle ..... E01H 5/098 37/259

* cited by examiner

CHUTE ROTATION ASSEMBLY FOR SNOW REMOVAL DEVICE

CROSS REFERENCE TO RELATED APPLICATION

This application claims priority to U.S. application No. 62/549,050 filed Aug. 23, 2017, the entire contents of which are hereby incorporated by reference in its entirety.

TECHNICAL FIELD

Example embodiments generally relate to outdoor equipment and, more particularly, to a chute rotation assembly for use with a device that employs a chute for directing discharge material such as snow.

BACKGROUND

Lawn care and other outdoor tasks associated with grooming and maintaining property are commonly performed using various tools and/or machines that are configured for the performance of corresponding specific tasks. Certain tasks, like snow removal, are typically performed by snow removal devices. The snow removal devices may, in some cases, be walk-behind models. However, snow removal device attachments can sometimes be added to lawn tractors or other riding lawn care vehicles as well.

Walk behind snow removal devices may be single stage or dual stage snow removal devices. A single stage snow removal device may include a high speed auger blade that is rotated at the front of the snow removal device. The rotation of the auger blade may intake snow and impart momentum on the snow to eject the snow through a chute all in one stage of operation. With a dual stage snow removal device, the auger blade may feed snow into an impeller in a first stage, and the impeller may impart momentum on the snow, in a second stage, to eject the snow through a chute. In such a dual stage example, the auger may operate at lower speeds because the impeller will provide a momentum boost for snow ejection.

The chute in either a single or dual stage snow removal device may be configured to be locally repositioned in some cases. For example, the operator may walk around from the operating position (e.g., behind the snow removal device and proximate to the handles and control console) to the front or side of the snow removal device and manually adjust the direction the chute faces.

BRIEF SUMMARY OF SOME EXAMPLES

Accordingly, in order to improve operator satisfaction in connection with using a snow removal device, some example embodiments may provide a chute rotation assembly. Such a chute rotation assembly may provide operators with a relatively easy and reliable way to position the chute from a handle assembly of the snow removal device.

In one example embodiment, a snow removal device is provided. The snow removal device may include an engine assembly operably coupled at least in part to a frame of the snow removal device. The snow removal device may further include a mobility assembly operably coupled to the frame and the engine assembly to provide mobility of the snow removal device responsive at least in part to operation of the engine assembly. The snow removal device may even further include an ejection assembly that includes a chute for ejecting material from the snow removal device, and a handle assembly that includes a lever assembly. Moreover, the snow removal device may also include a chute rotation assembly operably coupled to the chute of the ejection assembly. The chute rotation assembly may include a cable system, the cable system operably coupling the lever assembly to the chute rotation assembly. The chute rotation assembly may also include a disc clutch assembly configured to move between an engaged position and a disengaged position in response to actuation of the lever assembly, where when the disc clutch assembly is in the disengaged position, the chute is enabled to rotate between a plurality of positions.

In a further example embodiment, a chute rotation assembly for a snow removal device is provided. The chute rotation assembly may include a cable system, the cable system operably coupling a lever assembly of the snow removal device to the chute rotation assembly. The chute rotation assembly may also include a disc clutch assembly configured to move between an engaged position and a disengaged position in response to actuation of the lever assembly, where when the disc clutch assembly is in the disengaged position, a chute of the snow removal device is enabled to rotate between a plurality of positions.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
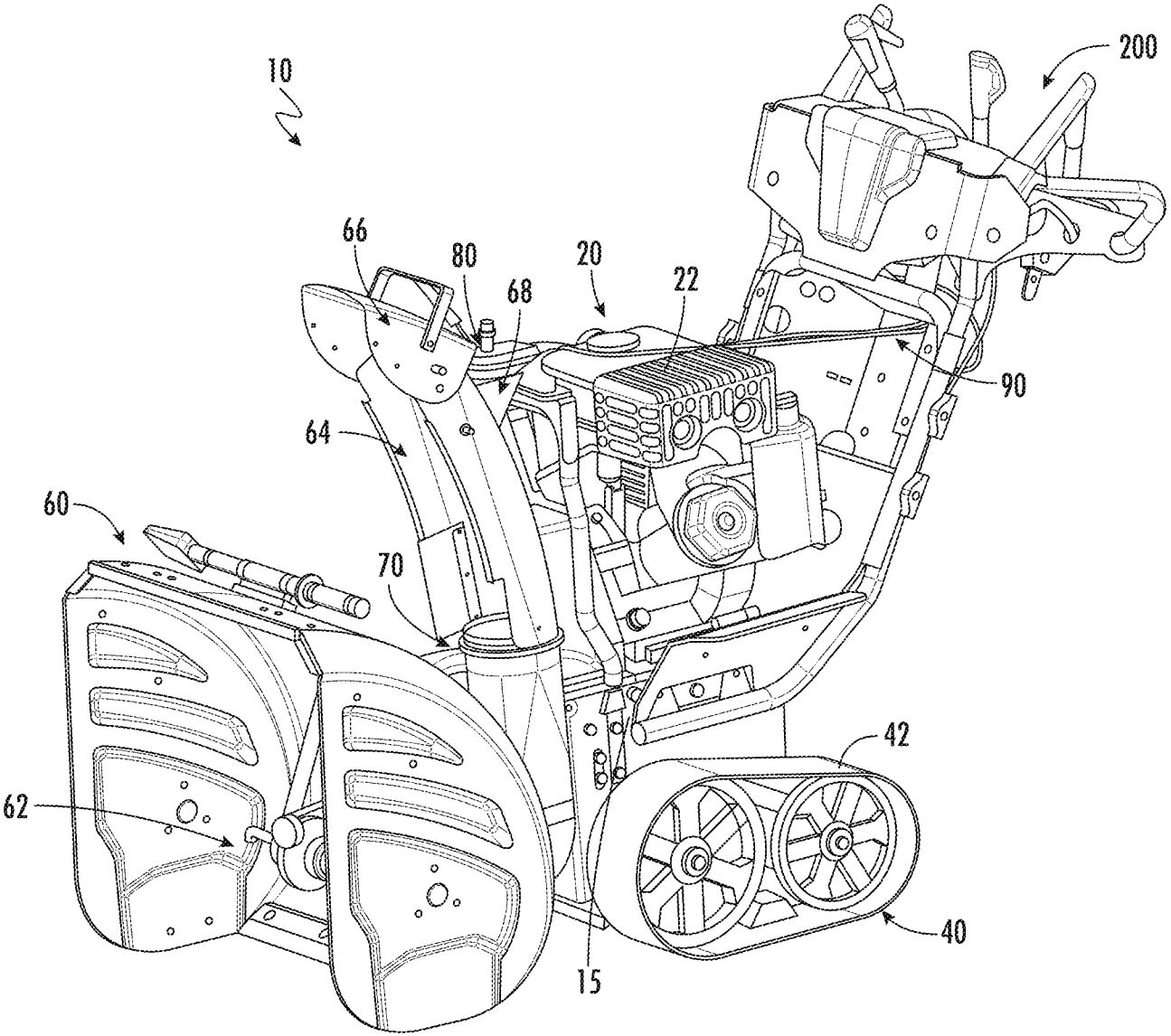
FIG. 1 illustrates a snow removal device according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments may improve an operator's experience associated with operating a snow removal device generally by improving the reliability of and the operator's experience associated with manipulating the position of a chute on the snow removal device. In an example embodiment, a chute rotation assembly may be provided that enables the user to adjust a position of the chute via a lever assembly that is disposed at the handle assembly of the snow removal device. Accordingly, the lever assembly may be configured to disengage and engage a disc clutch assembly of the chute rotation assembly in order to control rotation of the chute. Thus, the chute rotation assembly may be configured to move the disc clutch assembly between a disengaged position, in which the chute is configured to rotate between a plurality of positions, and an engaged position, in which the chute is not configured to rotate between the plurality of positions. The chute rotation assembly may be configured such that certain locking pieces, such as a pawl or latch, are not required to move the disc clutch assembly between the engaged and disengaged positions. Rather, the disc clutch assembly is configured such that it can simply and seamlessly move between the disengaged position and the engaged position based on the relative positions of two discs. Because there are no separate locking pieces locking the disc clutch assembly in the engaged position, any external force exerted on the chute (e.g., when an operator tries to manually position the chute) when the disc clutch assembly is in the engaged position will not cause any breakage of any parts or pieces of the chute rotation assembly. Thus, the chute rotation assembly may be configured to enable rotation of the chute while providing improved reliability and simplicity whenever the operator desires to rotate the chute.

FIG. 1 illustrates a walk behind snow removal device 10 according to an example embodiment. However, it should be appreciated that example embodiments may also be practiced in connection with any other device that may benefit from having a chute rotation assembly. Thus, chute positioning for other than walk behind snow removal device models or devices that eject materials may also be provided in accordance with some example embodiments.

As shown in FIG. 1, in some embodiments, the snow removal device 10 may include an engine assembly 20, a mobility assembly 40, an ejection assembly 60, a chute rotation assembly 80, and a handle assembly 200. FIG. 1 illustrates the snow removal device 10 with a hood assembly and side panels removed thereby exposing certain portions of the engine assembly 20, the mobility assembly 40, the ejection assembly 60, the chute rotation assembly 80, and the handle assembly 200. Accordingly, it should be understood that the snow removal device 10 may include the hood assembly and the side panels that may be either removable or rotatable to expose engine assembly 20 components or other snow removal device 10 components.

As mentioned above, the snow removal device 10 may include an engine assembly 20 operably coupled to a frame 15 or chassis of the snow removal device 10. The engine assembly 20 may include an engine 22. The engine 22 may be a gas-powered combustion engine or another type of engine, such as a battery-powered electric motor. The engine 22 may be supported by the frame 15 of the snow removal device 10. The engine 22 may be configured to selectively provide power to the mobility assembly 40 and the ejection assembly 60.

Furthermore, as shown in FIG. 1, the mobility assembly 40 may include wheels or tracks 42 on which a substantial portion of the weight of the snow removal device 10 may rest, when the snow removal device 10 is operated. The wheels or tracks 42 may also provide for mobility of the snow removal device 10. In this regard, for example, drive power may be selectively provided to the wheels or tracks 42 in some cases from the engine 22 of the engine assembly 20.

As further shown in FIG. 1, the snow removal device 10 may include an ejection assembly 60. The ejection assembly 60 of this example may include an auger 62, which enables the removal of snow by the snow removal device 10. When removing snow, the auger 62 may be operatively coupled to the engine assembly 20 of the snow removal device 10 such that the auger 62 may be selectively rotated about an axis that extends in a direction oriented between sides of the snow removal device 10 (and therefore parallel to the surface of the ground). Snow may be drawn inwardly and then ejected through a chute 64 of the ejection assembly 60. It should be appreciated, however, that example embodiments of the ejection assembly 60 disclosed herein may be adapted to be used in connection with single stage or dual stage snow removal devices.

As further shown in FIG. 1, the chute 64 of the ejection assembly 60 may include a chute deflector 66 that may be adjusted up and down to control the height of the discharge stream of snow that is ejected via the chute 64. In an example embodiment, a sleeve portion 68 of the chute 64 may be operably coupled to a portion of the chute rotation assembly 80. In this regard, for example, a base 70 of the chute 64 may be operably coupled to the ejection assembly 60, and the sleeve portion 68 of the chute 64 may form a portion of the chute rotation assembly 80. The chute rotation assembly 80, as described in greater detail below, may enable rotation of the chute 64 between a plurality of position or orientations, as desired by the user. In some embodiments, the base 70 of the chute 64, the sleeve portion 68 of the chute 64, the chute 64 itself, and the chute deflector 66 may be separate pieces operably coupled together. In other cases, the base 70 of the chute 64, the sleeve portion 68 of the chute 64, the chute 64 itself, and the chute deflector 66 may be unitary and molded or otherwise formed from a single piece of material. Thus, the chute 64 may not include separate pieces corresponding to the each component of the chute 64.

In an example embodiment, the chute rotation assembly 80 may be operably coupled between a portion of the frame 15 of the snow removal device 10 and the chute 64 of the ejection assembly 60. As mentioned above, the chute 64 may be configured to rotate between a plurality of positions via the chute rotation assembly 80. As will be described in greater detail in relation to FIG. 6 below, a lever assembly 220, which may be located at the handle assembly 200 of the snow removal device 10, may be operably coupled to the chute rotation assembly 80. In particular, a cable assembly 90 of the chute rotation assembly 80 may operably couple the lever assembly 220 to the chute rotation assembly 80. In some cases, a first portion 91 of the cable assembly 90 may be configured to control the engagement and disengagement of the chute rotation assembly 80, and a second portion 93 of the cable assembly may be configured to control the rotation of the chute rotation assembly 80 (see FIG. 4) Accordingly, when the user actuates the lever assembly 220, the unlocking or release of the lever assembly 220 may cause a corresponding movement in the first portion 91 of the cable assembly 90 of the chute rotation assembly 80 thereby causing a disengagement of the chute rotation assembly 80 to enable rotation of the chute 64. Furthermore, after the disengagement of the chute rotation assembly 80, a left or right actuation of the lever assembly 220 may cause a corresponding movement in the second portion 93 of the cable assembly 90 thereby causing a corresponding rotation of the chute rotation assembly 80 to rotate the chute 64. Accordingly, when the user desires the chute 64 to be rotated to a different position, the user may unlock and actuate the lever assembly 220 to cause rotation of the chute 64.

Figure 2:
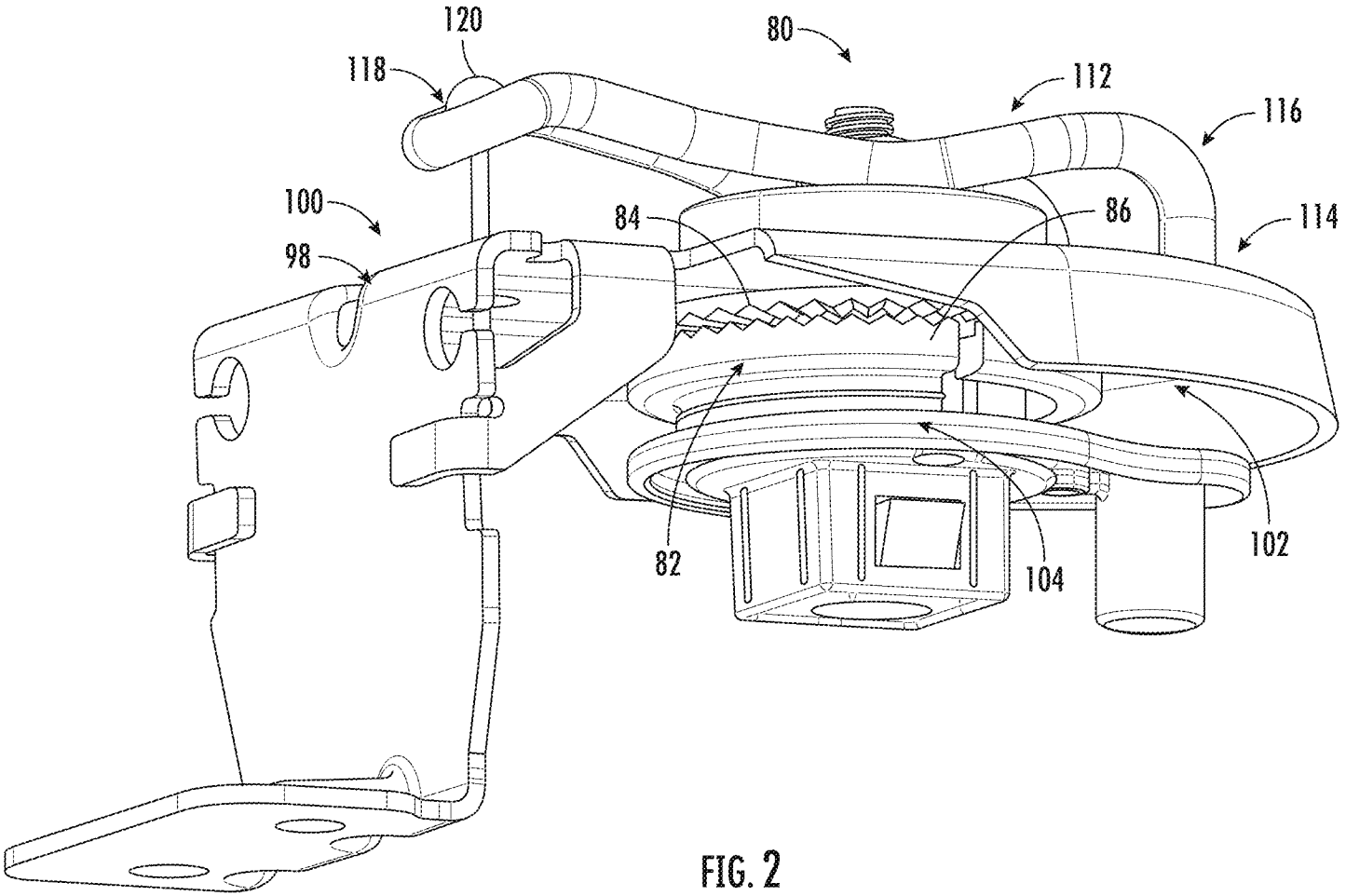
FIG. 2 illustrates a chute rotation assembly of a snow removal device according to an example embodiment.
Figure 3:
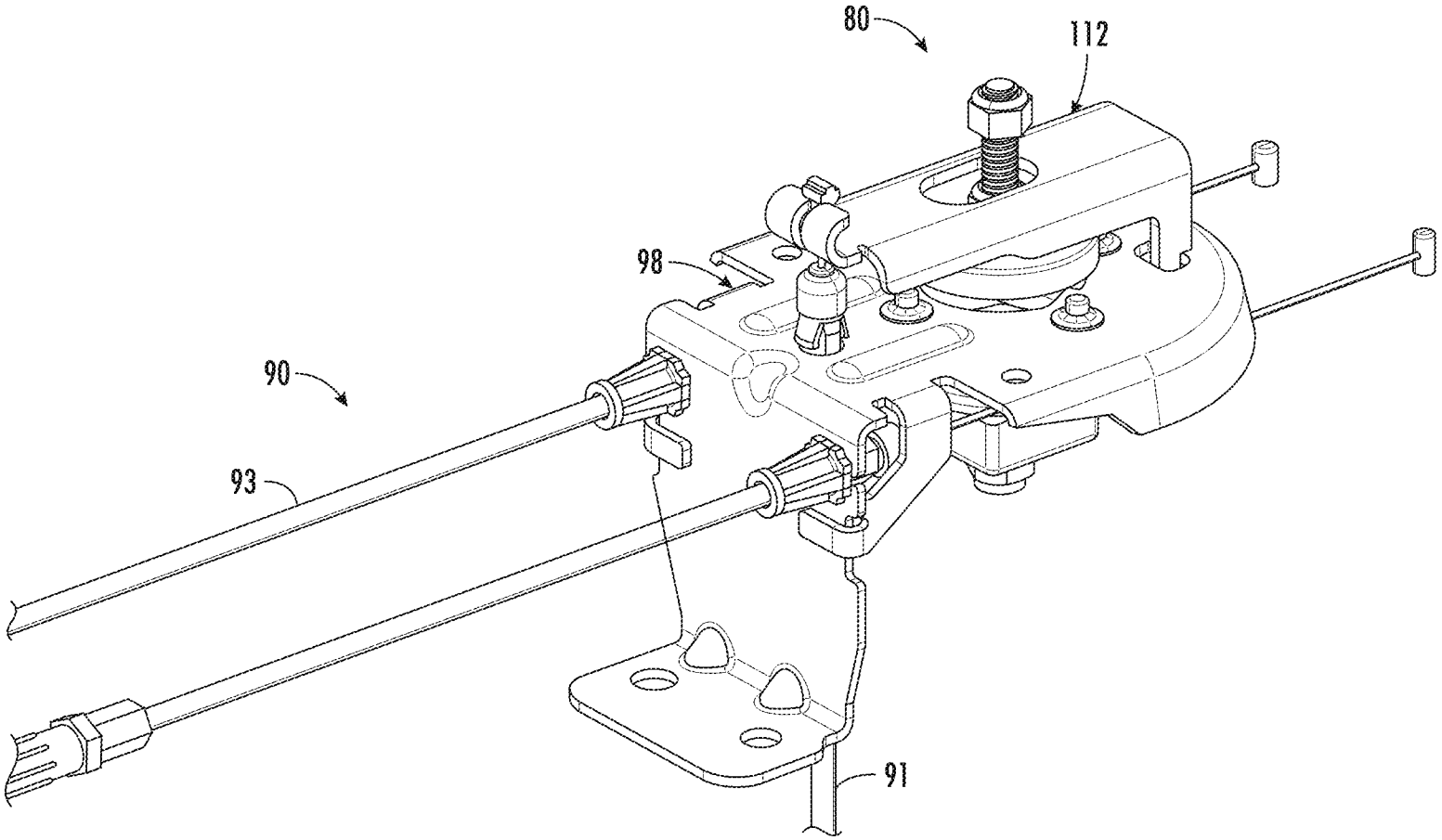
FIG. 3 illustrates a chute rotation assembly of a snow removal device according to a further example embodiment.
Figure 4:
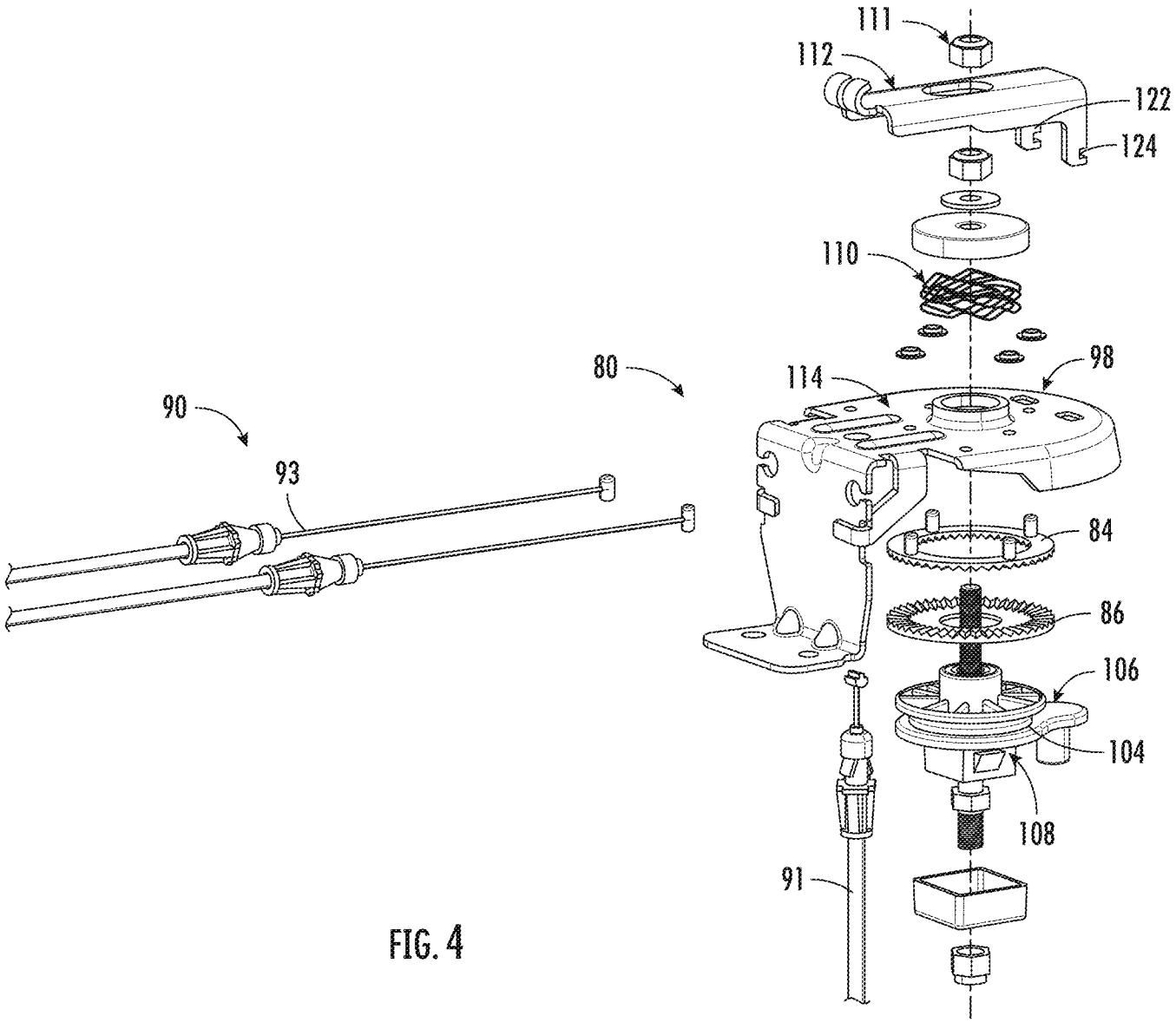
FIG. 4 illustrates an exploded view of a chute rotation assembly of a snow removal device according to an example embodiment.
Figure 5:
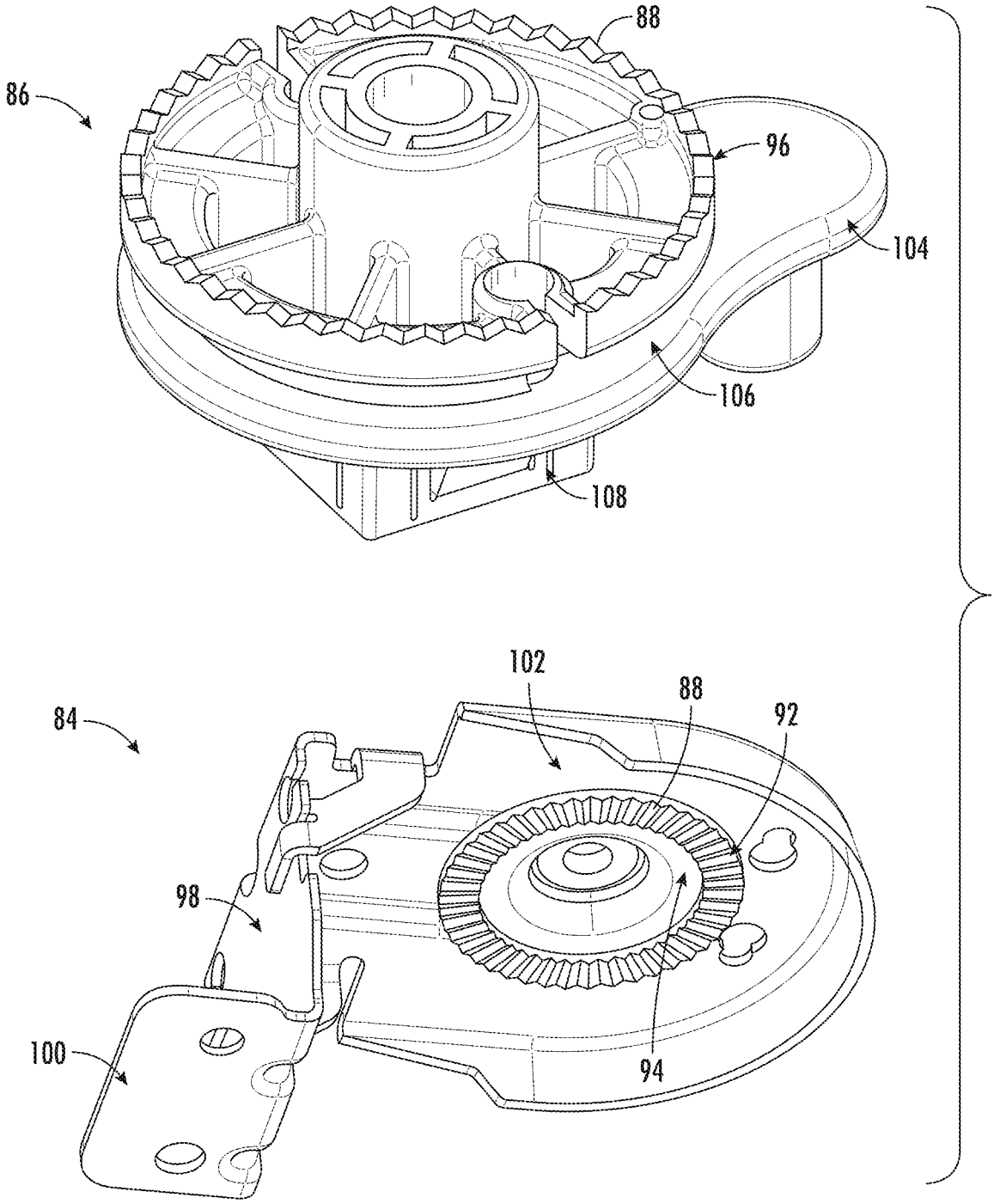
FIG. 5 illustrates a close-up view of a fixed disc and a chute rotator disc of a disc clutch assembly of a chute rotation assembly according to an example embodiment.

FIGS. 2-5 illustrate the chute rotation assembly 80 and its components according to example embodiments contained herein. FIG. 2, for example, illustrates a perspective view of the chute rotation assembly 80 according to an example embodiment. FIG. 3 illustrates a perspective view of the chute rotation assembly 80 according to a further example embodiment. FIG. 4 illustrates an exploded view of the chute rotation assembly 80 according to an example embodiment. FIG. 5 illustrates a perspective view of a fixed disc and a chute rotator disc of the chute rotation assembly 80 according to an example embodiment.

As shown in FIG. 2, the chute rotation assembly 80 may include a disc brake or disc clutch assembly 82. The disc clutch assembly 82 may be configured to move between an engaged position and a disengaged position in response to movement of the lever assembly 220 by the user between an unlocked position and a locked position. FIG. 2 illustrates the disc clutch assembly 82 in the disengaged position. Accordingly, when the lever assembly 220 is in the unlocked position, the disc clutch assembly 82 may be in the disengaged position thereby enabling rotation of the chute 64 in response to actuation of the lever assembly 220 by the user of the snow removal device 10. When the disc clutch assembly 82 is in the engaged position, the lever assembly 220 may be in the locked position and the disc clutch assembly 82 of the chute rotation assembly 80 may not be configured to enable rotation of the chute 64. In other words, in response to the unlocking of the lever assembly 220, the user may cause the disengagement of the disc clutch assembly 82 (i.e., movement from the engaged position to the disengaged position) thereby enabling the user to manipulate the chute 64 via the lever assembly 220 throughout the plurality of positions.

As further shown in FIGS. 2 and 4, the disc clutch assembly 82 may include a fixed disc 84 and a chute rotator disc 86. In accordance with an example embodiment contained herein, the fixed disc 84 may be configured to sit or lie in a first plane, and the chute rotator disc 86 may be configured to sit or lie in second plane. In some cases, the first plane and the second plane may be parallel to one other and spaced apart from each other, or in other words, one of the fixed disc 84 or the chute rotator disc 86 may be configured to sit directly above and parallel with the other of the fixed disc 84 or the chute rotator disc 86.

As shown in FIG. 5, each of the fixed disc 84 and the chute rotator disc 86 may include a plurality of teeth 88. In some example embodiments, the plurality of teeth 88 of each of the fixed disc 84 and the chute rotator disc 86 may be metal. In other cases, the plurality of teeth 88 of the fixed disc 84 and the chute rotator disc 86 may be plastic or made from any other material known by one of ordinary skill in the art.

The plurality of teeth 88 of each of the fixed disc 84 and the chute rotator disc 86 may be shaped and configured to enable the intermeshing of the plurality of teeth 88 of each of the fixed disc 84 and the chute rotator disc 86 thereby enabling the engagement of the fixed disc 84 and the chute rotator disc 86. The teeth 88 of the fixed disc 84 may extend radially around a circumference of the fixed disc 84. Moreover, in some example embodiments, each of the plurality of teeth 88 of the fixed disc 84 may be configured to extend from a first edge 92 of the fixed disc 84 to a second edge 92 of the fixed disc 84. Even further, each of the plurality of teeth 88 of the fixed disc 84 may be configured to extend perpendicular from a surface of the fixed disc 84 (e.g., extending out of the first plane and toward the second plane).

The teeth 88 of the chute rotator disc 86 may extend radially around a perimeter of the chute rotator disc 86. In some cases, the teeth 88 of the chute rotator disc 86 may be disposed on a lip portion 96 of the chute rotator disc 86. Moreover, in some example embodiments, each of the plurality of teeth 88 of the chute rotator disc 86 may be configured to extend perpendicularly away from a surface of the chute rotator disc 86. In other words, the plurality of teeth 88 of each of the fixed disc 84 and the chute rotator disc 86 may be configured to extend out of the respective plane in which the fixed disc 84 and the chute rotator disc 86 lie (e.g., out of the second plane and toward the first plane). The orientation and shape of the plurality of teeth 88 of each the fixed disc 84 and the chute rotator disc 86 enable the intermeshing of the plurality of teeth 88 of the fixed disc 84 with the plurality of teeth 88 of the chute rotator disc 86. The intermeshing of the plurality of teeth 88 enable the engagement of the fixed disc 84 and the chute rotator disc 86 in response to the locking of the lever assembly 220 via the user. Furthermore, the intermeshing of the plurality of teeth 88 is configured to prevent rotation of the chute 64 without the use of separate locking devices, such as a pawl or latch, attached to the either of the fixed disc 84 or the chute rotator disc 86. In cases where a user attempts manual rotation of the chute 64 when the fixed disc 84 and the chute rotator disc 86 are engaged, there would likely be no breaking of parts. Rather, the plurality of teeth 88 of the chute rotator disc 86 would slip relative to the plurality of teeth 88 of the fixed disc 84. Thus, even in cases where the user attempted to manually rotate the chute 64, there would be less of a chance of breaking or damaging the chute rotation assembly 80.

In some cases, the teeth 88 of the chute rotator disc 86 and teeth 88 of the fixed disc 84 may have different radial lengths. For example, as shown in FIG. 5, the teeth 88 of the chute rotator disc 86 have a shorter radial length than the teeth 88 of the fixed disc 84. However, this relationship could be reversed in some cases, or the teeth 88 of the chute rotator disc 86 and teeth 88 of the fixed disc 84 could have substantially the same radial lengths. Axial lengths may be substantially the same (and shaped the same) to maximize friction between the teeth 88 of the chute rotator disc 86 and teeth 88 of the fixed disc 84 when engaged. However, the different radial lengths may be desirable in some cases to allow for some "play" between the chute rotator disc 86 and the fixed disc 84 in case of slight misalignments therebetween.

As shown in FIGS. 2 and 5, in some example embodiments, the fixed disc 84 may be operably coupled to a disc clutch bracket 98 of the chute rotation assembly 80. The disc clutch bracket 98 of the chute rotation assembly 80 may be operably coupled to the portion of the frame 15 of the snow removal device 10 at a first end 100 of the disc clutch bracket 98. The fixed disc 84 may be operably coupled to a first side 102 of the disc clutch bracket 98.

As further shown in FIGS. 2 and 4, the chute rotator disc 86 may be operably coupled to a chute rotor bracket 104. In some cases, the chute rotator disc 86 may be operably coupled to a first side 106 of the chute rotor bracket 104. On a second side 108 of the chute rotator disc 86, the chute 64 may be operably coupled to the chute rotor bracket 104. In some cases, the first side 106 of the chute rotor bracket 104 may be opposite from the second side 108 of the chute rotator bracket 104. Accordingly, it should be understood that the fixed disc 84 and the chute rotator disc 86 may be oriented or sandwiched between the first side 102 of the disc clutch bracket 98 and the first side 106 of the chute rotator bracket 104.

As further shown in FIGS. 2-4, the disc clutch assembly 82 may further include a biasing mechanism 110 and a release lever 112. The release lever 112 may be operably coupled to a second side 114 of the disc clutch bracket 98. In some cases, the second side 114 of the disc clutch bracket 98 may be opposite from the first side 102 of the disc clutch bracket 98 to which the fixed disc 84 is operably coupled. In some cases, the release lever 112 may be configured to extend along the length or diameter of the second side 114 of the disc clutch bracket 98. Furthermore, a first end 116 of the release lever 112 may be pivotably coupled to the disc clutch bracket 98, and a second end 118 of the release lever 112 may be operably coupled to a first end 120 of the first portion 91 of the cable assembly 90. Accordingly, in response to movement of the first portion 91 of the cable assembly 90, the second end 118 of the release lever 112 may be configured to pivot between a position proximate the disc clutch bracket 98 and a position extending away from the disc clutch bracket 98. Moreover, as a second end of the first portion 91 of the cable assembly 90 may be operably coupled to the lever assembly 220, the unlocking and locking of the lever assembly 220 may cause a corresponding movement of the first portion 91 of the cable assembly 90 which causes a corresponding movement of the chute rotation assembly 80. Thus, in response to the unlocking of the lever assembly 220, the second end 118 of the release lever 112 may be configured to pivot toward or proximate the disc assembly bracket 98 thereby causing the disengagement of the disc clutch assembly 82 (i.e., movement of the disc clutch assembly 82 away from the disc clutch bracket 98 thereby disengaging the chute rotator disc 86 from the fixed disc 84). Even further, in response to the locking of the lever assembly 220, the second end 118 of the release lever 112 may be configured to pivot away from the disc clutch bracket 98 thereby causing the engagement of the disc clutch assembly 82 (i.e., movement of the disc clutch assembly 82 toward the disc clutch bracket 98 thereby engaging the chute rotator disc 86 with the fixed disc 84).

As shown in FIGS. 2-4, the first end 116 of the release lever 112 may include a first leg 122 and a second leg 124, and the first leg 122 and the second leg 124 of the release lever 112 may be pivotably coupled to the second side 114 of the disc clutch bracket 98. Furthermore, as shown in FIGS. 2-4, the first leg 122 and the second leg 124 may form a first portion of the release lever 112 that is configured to extend substantially perpendicular to the second side 114 of the disc clutch bracket 98. Furthermore, a second portion of the release lever 112 that is operably coupled to the first end 120 of the first portion 91 of the cable assembly 90 may extend approximately 90 degrees away from the first portion of the release lever 112 such that the second portion of the release lever 112 extends substantially parallel to the second side 114 of the disc clutch bracket 98. In some cases, as shown in FIG. 2, the release lever 112 may be a substantially u-shaped metal rod. As shown in FIG. 3, in accordance with a further example embodiment, the release lever 112 may be a substantially planar metal plate. It should be understood, however, that the release lever 112 may be formed from any known material or shape that is configured to pivot such that the engagement and disengagement of the disc clutch assembly 98 may occur.

As shown in FIG. 4, the disc clutch assembly 82 may further include a biasing mechanism 110. In some cases, the biasing mechanism may be a spring or the like. The biasing mechanism 110 may be operably coupled to or mounted to the second side 114 of the disc clutch bracket 98. In some cases, the biasing mechanism 110 may be attached directly to the disc clutch bracket 98, and the release lever 112 may be operably coupled to the biasing mechanism 110 proximate a center portion of the release lever 112. In other words, the release lever 112 may be operably coupled to the disc clutch bracket 98 at the first end 116 of the release lever 112, operably coupled to the first portion 91 of the cable assembly 90 at the second end 118 of the release lever 112, and operably coupled to the biasing mechanism 110 at a position between the first end 116 and second end 118 of the release lever 112. Thus, as the second end 118 of the release lever 112 pivots proximate or toward the disc clutch bracket 98 in response to movement or tensioning of the first portion 91 of the cable assembly 90, the release lever 112 may overcome the tension of the biasing mechanism 110 to push (via a nut/bolt assembly 111, as discussed below) the chute rotator disc 86 away from the fixed disc 84 thereby causing disengagement of the chute rotator disc 86 and the fixed disc 84. Furthermore, in response to the locking of the lever assembly 220, tension of the first portion 91 of the cable assembly 90 may be released. Accordingly, the biasing mechanism 110 may push the second end 118 of the release lever 112 away from the disc clutch bracket 98 causing the engagement of the fixed disc 84 and the chute rotator disc 86. It should be understood that the fixed disc 82, the chute rotator disc 86, the release lever 112, and the biasing mechanism 110 may be operably coupled through a center portion of each of the fixed disc 82, the chute rotator disc 86, the release lever 112, and the biasing mechanism 110 via a shaft, nut/bolt assembly 111, or the like.

Figure 6:
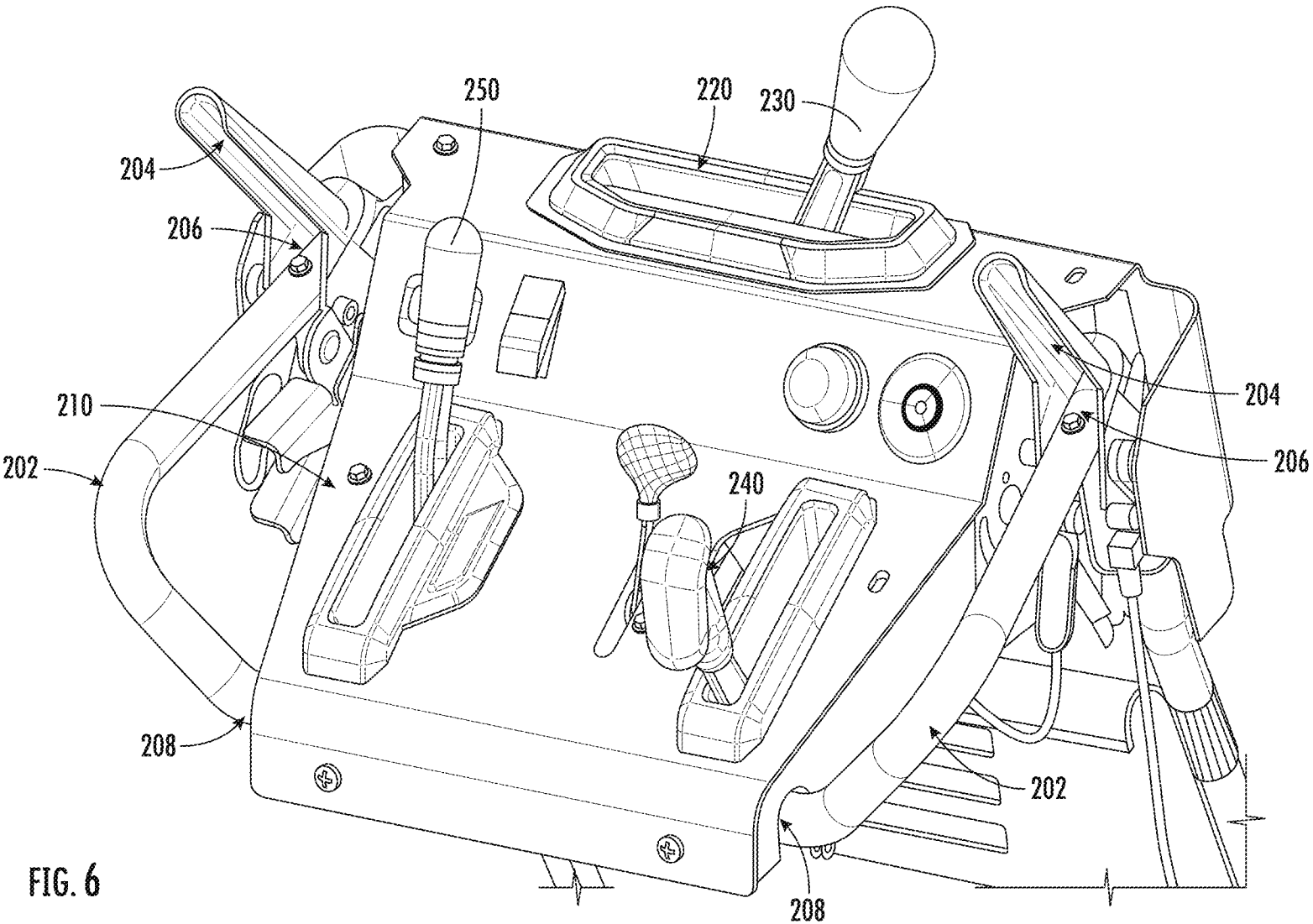
FIG. 6 illustrates a handle assembly of a snow removal device according to an example embodiment.

FIG. 6 illustrates the handle assembly 200 according to an example embodiment. The handle assembly 200 may be provided to be accessible from a rear of the snow removal device 10 by an operator standing or walking behind the snow removal device 10 (e.g., at an operator's station) and capable of pushing, steering, or otherwise controlling movement of the snow removal device 10 using the handle assembly 200 or some other steering assembly. In some examples, the handle assembly 200 may include at least two arms 202 that may extend up and rearward away from the engine assembly 20 to provide a structure for an operator to hold in order to facilitate direction and operation of the snow removal device 10. In some cases, the arms 202 may extend substantially parallel to each other. In some cases, the arms 202 may include handles 204 at a first end 206 of each respective one of the arms 202. In some cases, the handles 204 may include controls for snow removal device 10 operation in some cases.

In some example embodiments, the snow removal device 10 may further include a console 210 disposed to extend between the arms 202. In some example embodiments, the console 210 may provide some degree of structural support for respective second ends 208 of the arms 202. Alternatively or additionally, the console 210 may provide a structure to which accessories or components of the snow removal device 10 may be added. For example, in some embodiments, the console 210 may provide a structure for supporting the lever assembly 220.

The lever assembly 220 may include a chute rotation lever 230, a machine speed lever 240, and a chute deflector lever 250 Accordingly, the chute rotation lever 230 may be configured to control the rotation of the chute 64, as desired by the user. The machine speed lever 240 may be configured to control the speed of the snow removal device 10, and the chute deflector lever 250 may be configured to control the height of the chute deflector 66.

Figure 7:
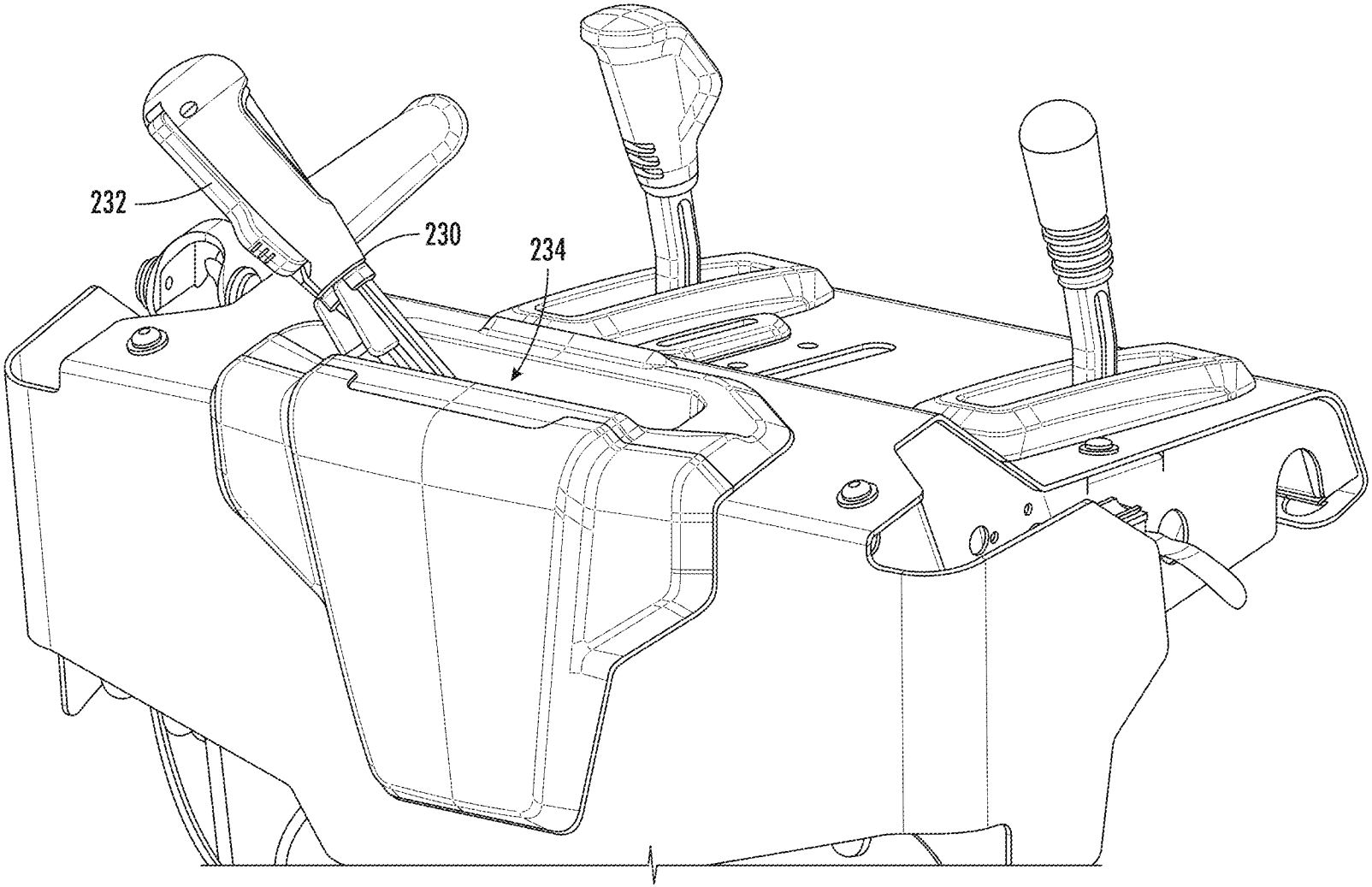
FIG. 7 illustrates a close-up view of a chute rotation lever of a lever assembly of a snow removal device according to an example embodiment.

FIG. 7 illustrates a close-up view of the chute rotation lever 230 of the lever assembly 220 according to an example embodiment. As mentioned above, the chute rotation lever 230 of the lever assembly 200 may be configured to control the rotation of the chute 64. In order to control the chute 64, the cable assembly 90 may be operably coupled to the chute rotation assembly 80, and a second end of the cable assembly 90 may be operably coupled to the chute rotation lever 230. Accordingly, in response to unlocking of the chute rotation lever 230, the chute rotation lever 230 may cause movement of the first portion 91 of the cable assembly 90 which causes a disengagement of the chute rotation assembly 80.

In some cases, the chute rotation lever 230 may include a trigger 232 that may be configured to unlock the chute rotation lever 230. It should be understood that in some embodiments the trigger 232 may be configured to extend toward the rear of the snow removal device 10 (e.g., in the direction toward the least two arms 202), as shown in FIG. 1. In other example embodiments, as shown in FIGS. 6 and 7, the trigger 232 may be configured to extend toward the front of the snow removal device 10 (e.g., in the direction toward the chute 64).

In response to actuation of the trigger 232 of the chute rotation lever 230, the chute rotation lever 230 may become unlocked thereby causing a movement of the first portion 91 of the cable assembly 90, which causes the disengagement of the chute rotation assembly 80. Furthermore, in response to the unlocking of the chute rotation lever 230 via the trigger 232, the chute rotation lever 230 may be configured to move left and right in a slot 234 that houses the chute rotation lever 230. In other words, after the actuation of the trigger 232 of the chute rotation lever 230 causes disengagement of the chute rotation assembly 80, the left and right movement the chute rotation lever 230 may cause a corresponding movement of the second portion 93 of the cable assembly 91 thereby enabling rotation of the chute 64. In other words, the user of the snow removal device 10 may actuate the trigger 232 of the chute rotation lever 230 to disengage the chute rotation assembly 80 to enable rotation of the chute 64. Upon the disengagement of the chute rotation assembly 80, the user may pivot the chute rotation lever 230 left or right along the slot 234 to cause a corresponding rotation of the chute 64. For example, a movement of the chute rotation lever 230 in a left direction may cause a corresponding movement of the chute 64 to the left or in a counter-clockwise direction, and a movement of the chute rotation lever 230 in a right direction may cause a right or clockwise direction movement of the chute 64.

Example embodiments therefore represent a snow removal device. The snow removal device may include an engine assembly operably coupled at least in part to a frame of the snow removal device. The snow removal device may further include a mobility assembly operably coupled to the frame and the engine assembly to provide mobility of the snow removal device responsive at least in part to operation of the engine assembly. The snow removal device may even further include an ejection assembly comprising a chute for ejecting material from the snow removal device, and a handle assembly that includes a lever assembly. Moreover, the snow removal device may also include a chute rotation assembly operably coupled to the chute of the ejection assembly. The chute rotation assembly may include a cable system, the cable system operably coupling the lever assembly to the chute rotation assembly. The chute rotation assembly may also include a disc clutch assembly configured to move between an engaged position and a disengaged position in response to actuation of the lever assembly, where when the disc clutch assembly is in the disengaged position, the chute is enabled to rotate between a plurality of positions.

In some embodiments, additional optional structures and/or features may be included or the structures/features described above may be modified or augmented. Each of the additional features, structures, modifications, or augmentations may be practiced in combination with the structures/features above and/or in combination with each other. Thus, some, all or none of the additional features, structures, modifications, or augmentations may be utilized in some embodiments. Some example additional optional features, structures, modifications, or augmentations are described below, and may include, for example, that the disc clutch assembly may include a fixed disc and a chute rotator disc, where when the fixed disc and the chute rotator disc are in the disengaged position, the chute may be enabled to rotate between the plurality of positions. Alternatively or additionally, the fixed disc may be configured to lie in a first plane, and where the chute rotator disc may be configured to lie in a second plane, the first plane and the second plane being parallel. In some cases, the fixed disc and the chute rotator disc may each include a plurality of teeth, where the plurality of teeth of each of the fixed disc and the chute rotator disc may be configured to be intermeshed when the fixed disc and the chute rotator disc are in the engaged position such that the chute is not enabled to rotate between the plurality of positions. Alternatively or additionally, each of the plurality of teeth may be configured to extend perpendicularly away from a respective surface of the fixed disc or the chute rotator disc out of the respective first plane or second plane. Alternatively or additionally, the plurality of teeth may be metal. In other example embodiments, the disc clutch assembly may include a release lever, where a portion of the release lever may be operably coupled to a first portion of the cable assembly. Alternatively or additionally, the disc clutch assembly further includes a disc clutch bracket, where the release lever may be configured to extend across a diameter of the disc clutch bracket, and where a first end of the release lever may be pivotably coupled to the disc clutch bracket, and where a second end of the release lever may be operably coupled to the first portion of the cable assembly. Alternatively or additionally, in response to actuation of the lever assembly, the release lever may be configured to pivot in a direction toward the disc clutch bracket thereby causing the disc clutch assembly to move from the engaged position to the disengaged position. In some cases, the disc clutch assembly may further include a biasing mechanism, where the biasing mechanism may be operably coupled to the release lever and the disc clutch bracket, where in response to actuation of the lever assembly, the release lever may pivot to overcome a biasing force of the biasing assembly thereby causing the disc clutch assembly to move from the engaged position to the disengaged position. Alternatively or additionally, the biasing mechanism may be a spring. In further example embodiments, the chute may include a deflector configured to control a height of a discharge stream of the ejected material. Alternatively or additionally, the lever assembly may include a chute rotation lever and a chute discharge lever, where the chute rotation lever may be configured to control the chute rotation assembly, and where the chute discharge lever may be configured to control the deflector. In some cases, the chute rotation lever may include a trigger, where in response to actuation of the trigger, the disc clutch assembly may be configured to move from the engaged position to the disengaged position.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A snow removal device comprising:

an engine assembly operably coupled at least in part to a frame of the snow removal device;

a mobility assembly operably coupled to the frame and the engine assembly to provide mobility of the snow removal device responsive at least in part to operation of the engine assembly;

an ejection assembly comprising a chute for ejecting material from the snow removal device;

a handle assembly comprising a lever assembly; and a chute rotation assembly operably coupled to the chute of the ejection assembly, wherein the chute rotation assembly comprises:

a cable system, the cable system operably coupling the lever assembly to the chute rotation assembly; and a disc clutch assembly configured to move between an engaged position and a disengaged position in response to actuation of the lever assembly;

wherein, when the lever assembly is in an unlocked position, the disc clutch assembly is in the disengaged position and the chute is enabled to rotate between a plurality of positions;

wherein, when the lever assembly is in a locked position, the disc clutch assembly is in the disengaged position and the chute is not enabled to rotate via the lever assembly between the plurality of positions;

wherein the disc clutch assembly comprises a fixed disc and a chute rotator disc, wherein when the fixed disc and the chute rotator disc are in the disengaged position, the chute is enabled to rotate between the plurality of positions, wherein the fixed disc and the chute rotator disc each comprise a plurality of teeth, wherein the plurality of teeth of each of the fixed disc and the chute rotator disc are configured to be intermeshed when the fixed disc and the chute rotator disc are in the engaged position such that the chute is not enabled to rotate between the plurality of positions.

2. The snow removal device of claim 1, wherein the fixed disc is configured to lie in a first plane, and wherein the chute rotator disc is configured to lie in a second plane, the first plane and the second plane being parallel.

3. The snow removal device of claim 1, wherein each of the plurality of teeth is configured to extend perpendicularly away from a respective surface of the fixed disc or the chute rotator disc out of the respective first plane or second plane.

4. The snow removal device of claim 1, wherein the plurality of teeth are metal.

5. The snow removal device of claim 1, wherein the chute comprises a deflector configured to control a height of a discharge stream of the ejected material.

6. The snow removal device of claim 5, wherein the lever assembly comprises a chute rotation lever and a chute discharge lever, wherein the chute rotation lever is configured to control the chute rotation assembly, and wherein the chute discharge lever is configured to control the deflector.

7. The snow removal device of claim 6, wherein the chute rotation lever comprises a trigger, wherein in response to actuation of the trigger, the disc clutch assembly is configured to move from the engaged position to the disengaged position.

8. A snow removal device comprising:

an engine assembly operably coupled at least in part to a frame of the snow removal device;

a mobility assembly operably coupled to the frame and the engine assembly to provide mobility of the snow removal device responsive at least in part to operation of the engine assembly;

an ejection assembly comprising a chute for ejecting material from the snow removal device;

a handle assembly comprising a lever assembly; and a chute rotation assembly operably coupled to the chute of the ejection assembly, wherein the chute rotation assembly comprises:

a cable system, the cable system operably coupling the lever assembly to the chute rotation assembly, and a disc clutch assembly configured to move between an engaged position and a disengaged position in response to actuation of the lever assembly;

wherein, when the lever assembly is in an unlocked position, the disc clutch assembly is in the disengaged position and the chute is enabled to rotate between a plurality of positions;

wherein, when the lever assembly is in a locked position, the disc clutch assembly is in the disengaged position and the chute is not enabled to rotate via the lever assembly between the plurality of positions;

wherein the disc clutch assembly further comprises a release lever, wherein a portion of the release lever is operably coupled to a first portion of the cable assembly;

wherein the disc clutch assembly further comprises a disc clutch bracket, wherein the release lever is configured to extend across a diameter of the disc clutch bracket, and wherein a first end of the release lever is pivotably coupled to the disc clutch bracket, and wherein a second end of the release lever is operably coupled to the first portion of the cable assembly.

9. The snow removal device of claim 8, wherein in response to actuation of the lever assembly, the release lever is configured to pivot in a direction toward the disc clutch bracket thereby causing the disc clutch assembly to move from the engaged position to the disengaged position.

10. The snow removal device of claim 9, wherein the disc clutch assembly further comprises a biasing mechanism, wherein the biasing mechanism is operably coupled to the release lever and the disc clutch bracket, wherein in response to actuation of the lever assembly, the release lever pivots to overcome a biasing force of the biasing assembly thereby causing the disc clutch assembly to move from the engaged position to the disengaged position.

11. The snow removal device of claim 10, wherein the biasing mechanism is a spring.

12. A chute rotation assembly for a snow removal device, the chute rotation assembly comprising:

a cable system, the cable system operably coupling a lever assembly of the snow removal device to the chute rotation assembly; and a disc clutch assembly configured to move between an engaged position and a disengaged position in response to actuation of the lever assembly;

wherein, when the lever assembly is in an unlocked position, the disc clutch assembly is in the disengaged position and a chute of the snow removal device is enabled to rotate between a plurality of positions;

wherein, when the lever assembly is in a locked position, the disc clutch assembly is in the disengaged position and the chute is not enabled to rotate via the lever assembly between the plurality of positions, wherein the disc clutch assembly further comprises a release lever, wherein a portion of the release lever is operably coupled to a first portion of the cable assembly, wherein the disc clutch assembly further comprises a disc clutch bracket, wherein the release lever is configured to extend across a diameter of the disc clutch bracket, and wherein a first end of the release lever pivotably coupled to the disc clutch bracket, and wherein a second end of the release lever is operably coupled to the first portion of the cable assembly, wherein in response to actuation of the lever assembly, the release lever is configured to pivot in a direction toward the disc clutch bracket thereby causing the disc clutch assembly to move from the engaged position to the disengaged position;

wherein the disc clutch assembly further comprises a biasing mechanism, wherein the biasing mechanism is operably coupled to the release lever and the disc clutch bracket, wherein in response to actuation of the lever assembly, the release lever pivots to overcome a biasing force of the biasing assembly thereby causing the disc clutch assembly to move from the engaged position to the disengaged position; and wherein the biasing mechanism is a spring.

13. The chute rotation assembly of claim 12, wherein the disc clutch assembly comprises a fixed disc and a chute rotator disc, wherein when the fixed disc and the chute rotator disc are in the disengaged position, the chute is enabled to rotate between the plurality of positions;

wherein the fixed disc is configured to lie in a first plane, and wherein the chute rotator disc is configured to lie in a second plane, the first plane and the second plane being parallel.

14. The chute rotation assembly of claim 12, wherein the chute comprises a deflector configured to control a height of a discharge stream of the ejected material, wherein the lever assembly comprises a chute rotation lever and a chute discharge lever, wherein the chute rotation lever is configured to control the chute rotation assembly, and wherein the chute discharge lever is configured to control the deflector, and wherein the chute rotation lever comprises a trigger, wherein in response to actuation of the trigger, the disc clutch assembly is configured to move from the engaged position to the disengaged position.

15. A chute rotation assembly for a snow removal device, the chute rotation assembly comprising:

a cable system, the cable system operably coupling a lever assembly of the snow removal device to the chute rotation assembly; and a disc clutch assembly configured to move between an engaged position and a disengaged position in response to actuation of the lever assembly, wherein when the disc clutch assembly is in the disengaged position, a chute of the snow removal device is enabled to rotate between a plurality of positions;

wherein the disc clutch assembly comprises a fixed disc and a chute rotator disc, wherein when the fixed disc and the chute rotator disc are in the disengaged position, the chute is enabled to rotate between the plurality of positions;

wherein the fixed disc and the chute rotator disc each comprise a plurality of teeth, wherein the plurality of teeth of each of the fixed disc and the chute rotator disc are configured to be intermeshed when the fixed disc and the chute rotator disc are in the engaged position such that the chute is not enabled to rotate between the plurality of positions;

wherein each of the plurality of teeth is metal and is configured to extend perpendicularly, away from a respective surface of the fixed disc or the chute rotator disc out of a respective first plane or a second plane.

* * * * *